US010665389B2

(12) United States Patent
Haug et al.

(10) Patent No.: US 10,665,389 B2
(45) Date of Patent: May 26, 2020

(54) ELECTRONIC SUB-ASSEMBLY AND METHOD FOR THE PRODUCTION OF AN ELECTRONIC SUB-ASSEMBLY

(71) Applicant: Würth Elektronik eiSos GmbH & Co. KG, Waldenburg (DE)

(72) Inventors: Martin Haug, München (DE); Dragan Dinulovic, München (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 340 days.

(21) Appl. No.: 15/564,626

(22) PCT Filed: Mar. 7, 2016

(86) PCT No.: PCT/EP2016/054777
§ 371 (c)(1),
(2) Date: Oct. 5, 2017

(87) PCT Pub. No.: WO2016/162153
PCT Pub. Date: Oct. 13, 2016

(65) Prior Publication Data

US 2018/0090269 A1 Mar. 29, 2018

(30) Foreign Application Priority Data

Apr. 7, 2015 (DE) ..... 10 2015 206 173

(51) Int. Cl.

| | |
|---|---|
| ***H01F 41/04*** | (2006.01) |
| ***H01F 27/255*** | (2006.01) |
| ***H01F 17/00*** | (2006.01) |
| ***H01F 27/29*** | (2006.01) |
| ***H01F 17/04*** | (2006.01) |

(Continued)

(52) U.S. Cl.
CPC ..... *H01F 41/046* (2013.01); *H01F 17/0013* (2013.01); *H01F 17/04* (2013.01); *H01F 27/255* (2013.01); *H01F 27/2804* (2013.01); *H01F 27/29* (2013.01); *H01F 27/292* (2013.01); *H01F 27/40* (2013.01); *H01F 41/0246* (2013.01); *H01F 41/043* (2013.01); *H01F 41/06* (2013.01); *H01F 2017/002* (2013.01);

(Continued)

(58) Field of Classification Search
CPC ..... H01F 41/046; H01F 2017/002
See application file for complete search history.

(56) References Cited

U.S. PATENT DOCUMENTS 6,181,225 B1 * 1/2001 Bettner ..... H01P 7/088 333/204
6,207,234 B1 3/2001 Jiang (Continued)

FOREIGN PATENT DOCUMENTS

JP 2013123007 A * 6/2013
JP H0888122 A 11/2013

*Primary Examiner* — Scott Bauer
(74) *Attorney, Agent, or Firm* — Boyle Fredrickson S.C.

(57) ABSTRACT

An electronic component that includes at least one main body composed of ferrite material, at least one coil embedded in the main body, and at least one conductor track which runs on a side of the main body from a bottom side to a top side of the main body configured such that the main body has at least two side surfaces which enclose an angle of less than 180 angular degrees, where the conductor track is arranged in a recess at the transition between the two side surfaces.

14 Claims, 2 Drawing Sheets

(51) Int. Cl.

| | |
|---|---|
| ***H01F 27/28*** | (2006.01) |
| ***H01F 27/40*** | (2006.01) |
| ***H01F 41/02*** | (2006.01) |
| ***H01F 41/06*** | (2016.01) |

(52) U.S. Cl.
CPC ..... *H01F 2017/0066* (2013.01); *H01F 2017/048* (2013.01); *H01F 2027/2809* (2013.01)

(56) References Cited

U.S. PATENT DOCUMENTS

| | | | | |
|---|---|---|---|---|
| 6,384,705 | B1 * | 5/2002 | Huang | H01F 17/0013 336/200 |
| 6,831,528 | B2 * | 12/2004 | Nagata | H01L 23/49822 257/E23.062 |
| 2005/0068148 | A1 * | 3/2005 | Yoshida | H01F 17/0013 336/200 |
| 2007/0296534 | A1 | 12/2007 | Carestro et al. | |
| 2009/0051476 | A1 | 2/2009 | Tada et al. | |
| 2011/0012701 | A1 * | 1/2011 | Lu | H01F 17/0013 336/200 |
| 2013/0314190 | A1 | 11/2013 | Yokoyama et al. | |
| 2013/0314194 | A1 | 11/2013 | Sato | |
| 2014/0055120 | A1 * | 2/2014 | Kubota | H01F 5/00 323/311 |
| 2014/0159849 | A1 | 6/2014 | Bae et al. | |
| 2014/0266547 | A1 | 9/2014 | Watanabe | |

* cited by examiner

ELECTRONIC SUB-ASSEMBLY AND METHOD FOR THE PRODUCTION OF AN ELECTRONIC SUB-ASSEMBLY

BACKGROUND

The invention relates to electronic component having at least one main body composed of ferrite material, at least one coil embedded in the main body, and at least one conductor track which runs on a side of the main body from a bottom side to a top side of the main body. The invention also relates to a method for producing an electronic component according to the invention.

The US laid-open specification US 2013/0314194 A1 has disclosed an electronic component having a coil embedded in the ferrite material. The coil is constructed as a multilayer coil. A through-connection between a top side and a bottom side of a main body of the electronic component is realized by means of passage bores, so-called vias, which are filled with conductive material.

The US laid-open specification US 2013/0314190 A1 has disclosed an electronic component having at least one main body composed of ferrite material, at least one coil embedded into the main body, and at least one conductor track which runs on a side of the main body from a bottom side to a top side of the main body. In the middle of opposite side surfaces of the cuboidal main body, there is provided in each case one groove which extends from a bottom side of the main body to a top side of the main body. Said grooves are filled, in sections, with conductive material. The conductive material however only partially fills the respective groove, such that the conductor track is recessed inward in relation to the respective side surface of the main body.

It is an aim of the invention to specify an improved electronic component and an improved method for producing the electronic component.

BRIEF SUMMARY

According to the invention, for this purpose, an electronic component having at least one main body composed of ferrite material, at least one coil embedded in the main body, and at least one conductor track which runs on a side of the main body from a bottom side to a top side of the main body, is provided, wherein the main body has at least two side surfaces which enclose an angle of less than 180°, and wherein the conductor track is arranged in a recess at the transition between the two side surfaces.

By virtue of the fact that the conductor track is thus arranged in the region of side edges of the main body, or the conductor track itself forms a side edge of the main body, parasitic inductances of the conductor tracks can be reduced. This is because the conductor tracks are surrounded by the ferrite material only on their side facing toward the main body. The influence of the ferrite material, which greatly increases the parasitic inductances, is thus considerably reduced in relation to conductor tracks that are completely surrounded by the ferrite material. Furthermore, in this way, multiple conductor tracks at the respective corner edges of the main body can be led from a bottom side of the main body to a top side of the main body. The conductor tracks at the respective corner edges of the main body thus extend over the entire length of the respective corner edge and thereby permit peripheral contacting from the bottom side to the top side of the main body or vice versa.

In a refinement of the invention, the main body is of cuboidal form, and in each case one recess is provided at the four side edges of the main body, wherein a conductor track is arranged in each recess.

In this way, four conductor tracks can be led from a bottom side of the main body to a top side of the main body, wherein each of said conductor tracks is surrounded by ferrite material only on the side facing toward the main body.

In a refinement of the invention, the main body is of prismatic form, wherein in each case one recess is provided at at least two side edges of the main body, and wherein a conductor track is arranged in each recess.

For example, if multiple conductor tracks are required between the bottom side and the top side of the main body, the main body may be of prismatic form, for example in the form of a regular hexagon or regular octagon.

In a refinement of the invention, a top side of the main body is equipped with conductor tracks.

Such conductor tracks are then connected to the conductor tracks on the side edges of the main body, and serve for the arrangement and interconnection of further electronic components on the top side of the main body, for example capacitors and chips with integrated circuits.

In refinement of the invention, the electronic component is formed as a DC-DC converter.

In this way, a so-called power module with an embedded inductance can be constructed in an extremely space-saving and thus highly integrated manner. Such energy supply modules with embedded inductances are characterized by very small dimensions and small volumes and therefore exhibit high power densities. Such energy supply modules are ideal for portable electronic devices.

In a refinement of the invention, the embedded coil is formed as a multilayer coil.

In this way, the main body can be produced entirely by thick-film technology.

In a refinement of the invention, a bottom side of the main body is equipped with contact pads.

In this way, the electronic component can be simultaneously fastened and electrically contacted to a circuit board in a very simple manner.

The problem on which the invention is based is also achieved by means of a method for producing an electronic component according to the invention, in which method the following steps are provided: producing a block from ferrite material with multiple coils embedded therein, producing passage bores in the block from a top side of the block to a bottom side of the block, filling the passage bores with electrically conductive material and severing the block along the connecting lines between the passage bores, wherein the severing of the block is performed such that the block is divided into multiple main bodies with in each case at least one coil embedded therein, and that the conductive material in the passage bores is divided into multiple conductor tracks which are arranged in each case at an edge between two side surfaces of a main body.

In this way, it is possible in a surprisingly simple manner for the conductor tracks which lead from the bottom side to the top side of the main body of the electronic component to be produced in one working step with the severing of the block into multiple main bodies.

In a refinement of the invention, the production of the block with multiple embedded coils is performed by means of successive application of multiple layers to a substrate by thick-film technology.

Alternatively, the production of the block with multiple embedded coils may also be performed by compression molding of a ferrite material powder, wherein the multiple coils are embedded into the ferrite material powder.

In a refinement of the invention, the production of the passage bores is performed by means of mechanical drilling, by means of a laser, by means of sandblasting or the like.

In a refinement of the invention, the filling of the passage bores is performed by introduction of a conductive paste or by galvanic deposition of an electrically conductive material.

Further features and advantages of the invention will emerge from the claims and from the following description of preferred embodiments of the invention in conjunction with the drawings. Individual features of the various embodiments illustrated in the drawings and described may in this case be combined with one another in any desired manner without departing from the scope of the invention.

DETAILED DESCRIPTION

Figure 1:
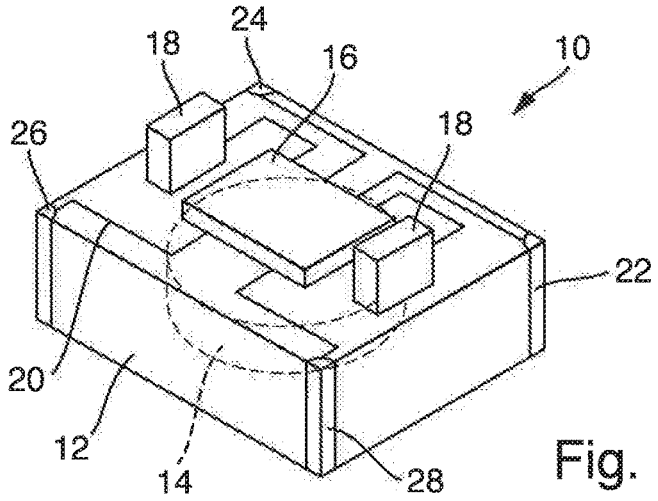
FIG. 1 shows a schematic illustration of an electronic component according to the invention obliquely from above.

The illustration of FIG. 1 schematically shows an electronic component 10 which is formed as an energy supply module and which forms, for example, a step-down voltage converter. The electronic component has a main body 12 which is of cuboidal form and which has a top side and a bottom side and four side surfaces. The main body 12 is composed of ferrite material, and a coil 14 is embedded into the ferrite material of the main body. In the view of FIG. 1, the coil 14 is itself not visible and is therefore illustrated by dashed lines. A chip 16 with an integrated electronic circuit is arranged on the top side of the main body 12. Also arranged on the top side of the main body 12 are two capacitors 18. Also arranged on the top side of the main body are multiple conductor tracks 20 which are merely schematically indicated. The conductor tracks 20 connect the capacitors 18 and the chip 16 to one another and to conductor tracks 22, 24, 26 and 28 which lead from the top side of the main body 12 to the bottom side. On the bottom side of the main body 12 there are arranged multiple contact pads 30, see FIG. 3, wherein a contact pad 30 is arranged at each corner of the bottom side of the main body 12 and electrically connected to in each case one conductor track 22, 24, 26, 28.

Figure 3:
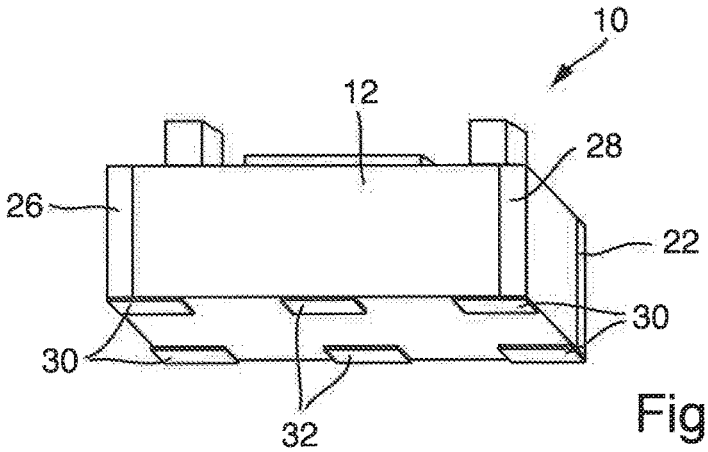
FIG. 3 shows a schematic view of the electronic component from FIG. 1 obliquely from below.

The further contact pads 32 which can be seen on the bottom side of the main body 12 in FIG. 3 and which are arranged in the middle of the relatively long side edges of the bottom side may, but need not necessarily, be electrically interconnected, though may also merely be provided for the reliable fastening of the main body 12 to a circuit board (not illustrated).

As can be seen in FIG. 1, the conductor tracks 22, 24, 26, 28 are arranged in each case at the side edges of the cuboidal main body 12. The conductor tracks 22, 24, 26, 28 are self-evidently composed of electrically conductive material and are surrounded by the ferrite material of the main body 12 only on their side facing toward the main body 12. In this way, the parasitic inductances of the conductor tracks 22, 24, 26, 28 can be kept low in relation to conductor tracks which are completely surrounded by ferrite material.

As can be seen in FIG. 1, the conductor tracks 22, 24, 26, 28 each have a quadrant-shaped cross section. Said quadrant-shaped cross section arises as a result of the fact that the conductor tracks 22, 24, 26, 28 are formed in each case from a circular cylinder which has been severed twofold. This will be discussed in more detail further below.

Figure 2:
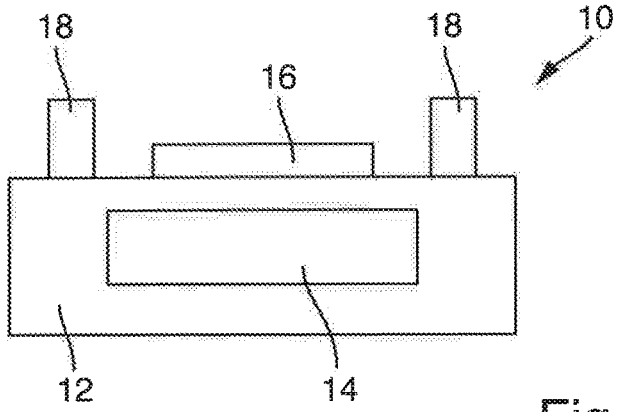
FIG. 2 shows a schematic sectional view of the electronic component from FIG. 1.

The illustration of FIG. 2 shows a schematic sectional view of the electronic component 10 from FIG. 1. The coil 14 is embedded in the main body 12. Electrical terminals of the coil 14, which connect the coil 14 to the top side of the main body 12, are not illustrated, for the sake of simplicity. The capacitors 18 and the chip 16 are arranged on the top side of the main body 12. In the sectional view of FIG. 2, the conductor tracks 22, 24, 26, 28 are not visible.

In the case of the electronic component 10 illustrated in FIGS. 1 to 3, it is thus the case that four conductor tracks 22, 24, 26, 28 lead from the bottom side to the top side of the main body 12. If there is a need for more than four conductor tracks which are to lead from the bottom side to the top side of the main body 12, then the main body 12 may also have a prismatic shape, for example with a hexagonal or octagonal outline. Conductor tracks would then lead from the bottom side to the top side at the respective side edges of the main body. It is essential to the invention that the conductor tracks 22, 24, 26, 28 are arranged in in each case one recess at the transition between two side surfaces of the main body, wherein said side surfaces enclose an angle of less than 180°. In this way, it can be ensured that the conductor tracks are surrounded by ferrite material only on their side facing toward the main body. This in turn leads to the formation of only low parasitic inductances of the conductor tracks 22, 24, 26, 28.

Figure 4A:
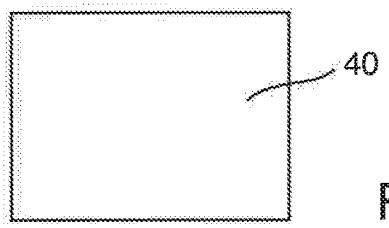
FIGS. 4*a* to 4*f* show successive production steps of the method according to the invention.
Figure 4B:
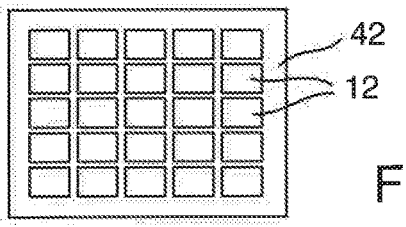

FIG. 4*a* shows a first step during the production of the electronic component 10 from FIGS. 1 to 3. FIG. 4*a* shows a substrate 40, onto which multiple layers composed of ferrite paste and silver paste have subsequently been printed by thick-film technology. This is performed in a known manner, such that, see FIG. 4*b*, a block 42 with multiple main bodies 12 composed of ferrite material with in each case at least one embedded coil is formed. The embedded coils are then constructed as a multilayer coil and are composed of the printed-on silver layers. The silver layers and the ferrite paste layers are printed on in a known manner by means of masks, such that the structure of a coil embedded in ferrite material is formed.

As an alternative to the thick-film method described above, it is also possible for multiple coils wound from wire to be embedded into a ferrite powder material, and for a block composed of ferrite material with multiple embedded coils to then be produced by compression molding.

Figure 4C:
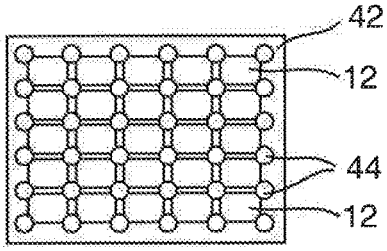

FIG. 4*c* shows the block 42 produced in the step described above, which block comprises multiple main bodies 12, wherein, as has already been discussed above, the main bodies 12 are still integral with the block 42. As has been stated, the block 42 may be produced either by means of thick-film methods or by means of compression molding of a ferrite material powder.

As per FIG. 4*c*, in a further method step, passage bores 44 are now formed into the block 42. The passage bores 44 are arranged in a grid so as to overlap in each case one side edge of the main bodies 12. As a result of the formation of the passage bores 44 at the corners of the main bodies 12, four circular-sector-shaped, in particular quadrant-shaped, recesses are formed at the side edges in each of the main bodies 12.

Figure 4D:
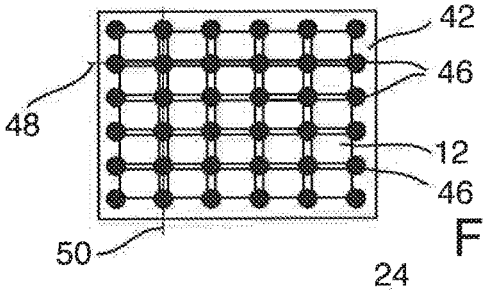

Said passage bores 44 are then, see FIG. 4*d*, filled with conductive material 45. This may be performed by filling the passage bores using a conductive paste or else by means of galvanic deposition. In the state of FIG. 4*d*, a unipartite block 42 is now present, which has multiple main bodies 12, wherein the main bodies 12 are connected at their side edges by means of the cylinders formed by conductive material 46.

The block 42 is then severed such that the main bodies 12 are separated and such that the circular cylinders composed of conductive material 46 formed in the passage bores are each severed into four pieces of equal size. By way of example, a first severing line 48, which runs horizontally in FIG. 4*d*, and a severing line 50, which runs vertically in FIG. 4*d*, are indicated. At the intersection point of the two severing lines 48, 50, it can be seen that the circular cylinder composed of conductive material 46 is severed into four parts of equal size and each with a quadrant-shaped cross section.

Figure 4E:
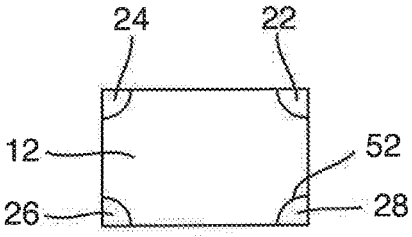

After the severing, see FIG. 4*e*, it is therefore the case that multiple main bodies 12 are present which, at their four side edges, are each equipped with conductor tracks 22, 24, 26, 28 at the respective side edges. As can be seen in FIG. 4*e*, the main body 12 has, at its four side edges, in each case one recess 52 of circular-sector-shaped cross section, which recess extends continuously from a bottom side of the main body 12 to the top side of said main body and is filled with conductive material such that the conductor tracks 22, 24, 26, 28 in each case form the side edge of the cuboidal main body 12.

It can also be seen from FIG. 4*e* that the conductor tracks 22, 24, 26, 28 are surrounded by ferrite material only on their side facing toward the volume of the main body 12. In a direction averted from the main body, the conductor tracks 22, 24, 26, 28 themselves form sections of the side surfaces of the main body 12, and are therefore not embedded in ferrite material on said sides.

Figure 4F:
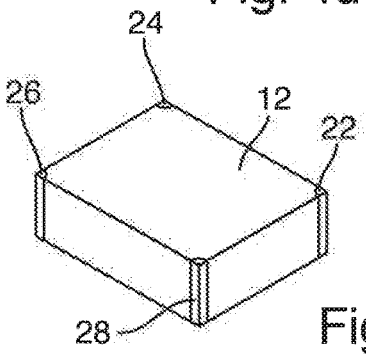

The arrangement of the conductor tracks 22, 24, 26 and 26 on the cuboidal main body 12 can also be seen in FIG. 4*f*.

After the main body 12 has been produced as illustrated in FIG. 4*f*, the bottom side of the main body 12 can be equipped with the contact pads 30, 32, see also FIG. 3. Conductor tracks 20 may be applied to the top side of the main body, see FIG. 1, and then a chip 16 and capacitors 18 may be mounted, in order to complete the production of the electronic component 10.

The invention claimed is:

1. An electronic component, comprising:

at least one main body composed of ferrite material, at least one coil embedded in the main body, and at least one conductor track which runs on a side of the main body from a bottom side to a top side of the main body, wherein the main body has at least two side surfaces which enclose an angle of less than 180 angular degrees, wherein the conductor track is arranged in a recess at the transition between the two side surfaces, wherein a top side of the main body is equipped with conductor tracks, wherein a chip with an integrated circuit is arranged on a top side of the main body, wherein a bottom side of the main body is equipped with contact pads, and wherein said conductor track at the transition between the two side surfaces extends over the entire length of the transition between the two side surfaces and wherein said conductor track electrically connects at least one contact pad at the bottom side with at least one conductor track on the top side of the main body.

2. The electronic component as claimed in claim 1, wherein the main body is of cuboidal form, in that in each case one recess is provided at the four side edges of the main body, and in that a conductor track is arranged in each recess.

3. The electronic component as claimed in claim 1, wherein the main body is of prismatic form, in that in each case one recess is provided at two or more side edges of the main body, and in that a conductor track is arranged in each recess.

4. The electronic component as claimed in claim 3, wherein a base surface of the prismatic main body forms a regular hexagon or a regular octagon.

5. The electronic component as claimed in claim 1, wherein at least one capacitor is arranged on a top side of the main body.

6. The electronic component as claimed in claim 1, wherein the electronic component is formed as a DC-DC converter.

7. The electronic component as claimed in claim wherein the embedded coil is formed as a multilayer coil.

8. The electronic component as claimed in claim 1, wherein said conductor track has a quadrant shaped cross section.

9. A method for producing an electronic component as claimed in claim 1, comprising:

producing a block from ferrite material with multiple coils embedded therein, producing passage bores in the block from a top side of the block to a bottom side of the block, filling the passage bores with electrically conductive material and severing the block along the connecting lines between the passage bores such that the block is divided into multiple main bodies with in each case at least one coil embedded therein, and the conductive material in the passage bores is divided into multiple conductor tracks which are arranged in each case at an edge between two side surfaces of a main body, equipping the block with conductor tracks on a top side of the main body, arranging a chip with an integrated circuit on the top side of the main body, equipping a bottom side of the main body with contact pads, and connecting at least one of the contact pads at the bottom side of the main body with at least one conductor track on the top side of the main body by means of at least one conductor track arranged at an edge between two side surfaces of the main body.

10. The method as claimed in claim 9, wherein the production of the block with multiple embedded coils is produced by means of successive application of multiple layers to a substrate by thick-film technology.

11. The method as claimed in claim 9, wherein the production of the block with multiple embedded coils is performed by compression molding of a ferrite material powder, wherein the multiple coils are embedded into the ferrite material powder.

12. The method as claimed in claim 9, wherein the production of the passage bores is performed by means of mechanical drilling, by means of a laser, by means of sandblasting or the like.

13. The method as claimed in claim 9, wherein the filling of the passage bores is performed by introduction of a conductive paste or by galvanic deposition of an electrically conductive material.

14. The method as claimed in claim 9, further comprising completely tilling the passage bores with electrically conductive material.

* * * * *